US005829456A

United States Patent [19]

Furukawa

[11] Patent Number: 5,829,456

[45] Date of Patent: Nov. 3, 1998

[54] HAIR CURLER

[75] Inventor: Toshiyuki Furukawa, Osaka, Japan

[73] Assignee: Lucky Corporation Co., Ltd, Osaka, Japan

[21] Appl. No.: 549,672

[22] PCT Filed: Mar. 31, 1994

[86] PCT No.: PCT/JP94/00552

§ 371 Date: Nov. 30, 1995

§ 102(e) Date: Nov. 30, 1995

[87] PCT Pub. No.: WO95/56658

PCT Pub. Date: Oct. 12, 1995

[51] Int. Cl.[6] ..... A45D 2/28

[52] U.S. Cl. ..... 132/258; 132/252

[58] Field of Search ..... 132/248, 249, 132/250, 251, 252, 254, 255, 258, 259, 226, 245, 253, 260

[56] References Cited

U.S. PATENT DOCUMENTS

| | | | |
|---|---|---|---|
| 2,473,115 | 6/1949 | Vaughn | 132/258 |
| 3,008,475 | 11/1961 | Solomon | 132/255 |
| 3,067,755 | 12/1962 | Hoffmann et al. | 132/255 |
| 3,200,825 | 8/1965 | Sidelman | 132/258 |
| 3,223,094 | 12/1965 | Bolinger | 132/258 |
| 3,250,281 | 5/1966 | Gresham et al. | 132/258 |
| 4,056,109 | 11/1977 | Takai | 132/255 |
| 4,630,622 | 12/1986 | Foreman . | |
| 5,467,788 | 11/1995 | Kimura | 132/254 |

FOREIGN PATENT DOCUMENTS

| | | |
|---|---|---|
| 5-16961 | 5/1993 | Japan . |

*Primary Examiner*—Todd E. Manahan
*Assistant Examiner*—E. Robert
*Attorney, Agent, or Firm*—Oblon, Spivak, McClelland, Maier & Neustadt, P.C.

[57] ABSTRACT

A hair curler having a pair of clasps for clasping hair between each of the clasps and the outer circumferential surface of a roller, and a cover for covering about a half of the outer circumferential surface of the roller. The cover and the pair of clasps are integrally molded from a synthetic resin. The cover is reversibly bent with elastic deformation along the outer circumferential surface of the roller.

15 Claims, 24 Drawing Sheets

HAIR CURLER

BACKGROUND OF THE INVENTION

1. Field of the Invention

The present invention relates to a hair curler for rolling to curl a strand of hair.

2. Background Art

A prior-art hair curler, as disclosed in Japanese Utility Model Publication No. Hei 5-16961, as shown in FIG. 37–FIG. 39, has a roller 1 and a rectangular setting frame 4 having a pair of clasps 2, 2 for holding the roller 1 radially from both sides and a pair of connecting portions 3, 3 connecting the ends of the clasps 2, 2 with each other; the setting frame 4 is releasably engaged with both ends in an axial direction of the roller 1 through the pair of connecting portions 3, 3; and a cover 5 for covering about a half of the outer periphery of the roller 1 between the clasps 2, 2. In this case, the setting frame 4 is produced of a synthetic resin, while the cover 5 is produced of a net-like flexible material of knitted yarn, and therefore both ends 5A, 5A of the cover 5 are fixedly embedded by insert molding in the pair of clasps 2, 2 of the setting frame 4. In this case, both ends of the cover 5 easily bends to change the bending direction of the cover, that is, either side of the cover 5 is usable on the roller 1 side. The hair curler, therefore, can be handled very easily when a strand of hair is rolled on the roller 1.

Another prior-art hair curler, as shown in FIGS. 40 and 41, has a roller 1 and a setting frame 4 including a pair of clasps 2, 2 for holding the roller 1 radially from both sides, and a rectangular setting frame 4 having a pair of connecting portions 3, 3 for connecting the ends of the clasps 2, 2 with each other, a central holding portion 7 provided at center between the pair of clasps of the setting frame 4, and a pair of circular connecting pieces 8, 8 provided for connecting both ends of the central holding portion 7 to both ends of the pair of clasps 2, 2; the pair of clasps 2, 2, the pair of connecting portions 3, 3, the central holding portion 7 and the connecting pieces 8, 8 of the setting frame 4 being formed of a synthetic resin in one body.

The former, however, has the following problem that since the setting frame 3 is produced of a synthetic resin while the cover 5 is of a net-like flexible material of knitted yarn, both ends 5A, 5A of the cover 5 must be fixedly embedded by insert molding in the pair of clasps 2, 2 of the setting frame 4, making the insert molding process very troublesome and the manufacturing process complicated.

Also the cover 5, produced of a net-like flexible material of knitted yarn, deflects as indicated by a chain line in FIGS. 37 to 39 when used, deteriorating in shape retention, whereby the hair curler will fail to hold the hair well in between the cover 5 and the roller 1; that is, the rolled state of the hair on the roller 1 can not securely be maintained.

In the case of the latter, since the setting frame 3 can easily be manufactured of a synthetic resin but there is left a large space between the pair of clasps 2, 2 and the central holding portion 7, a strand of hair rolled on the roller 1 is clasped insufficiently; that is, the rolled state of the hair on the roller 1 can not securely be held. Furthermore, in this case, the connecting pieces 8, 8, having no flexibility, can not be curved to the reverse side as indicated by a chain line in FIG. 41. The hair curler, therefore, is hard to handle when rolling a strand of hair on the roller 1.

In view of the above-described various problems inherent to the heretofore known arts, it is an object of the present invention to provide a hair curler which facilitates the manufacture and assembling of the setting frame and the cover, is easy to handle, and can clasp the hair well between the cover and the roller.

SUMMARY OF THE INVENTION

In the hair curler of the present invention which has a roller 11, and a rectangular setting frame 19 including a pair of clasps 20, 20 for holding the roller 11 radially from both sides and a pair of connecting portions 21 and 22 for connecting the pair of clasps 20, 20 for holding the roller 11 radially from both sides; the setting frame 19 being releasably engaged with both ends in an axial direction of the roller 11 through the pair of connecting portions 21 and 22, and provided with a cover 27 for covering about a half of the outer periphery of the roller 11 between the clasps 20, 20; the cover 27 and the pair of clasps 20, 20 of the setting frame 19 are integrally molded of a synthetic resin; the cover 27 is formed in a mesh-like type having a multitude of air holes 33; and the pair of clasps 20, 20 are connected to the pair of connecting portions 21 and 22 of the setting frame 19 respectively so that the cover 27 may be reversibly bent with elastic deformation along the outer periphery of the roller 11.

Furthermore, in the hair curler of the present invention having the roller 11, and the rectangular setting frame 19 including a pair of clasps 20, 20 for holding the roller 11 radially from both sides and a pair of connecting portions 21 and 22 for connecting the ends of the clasps 20, 20 with each other; the setting frame 19 being releasably engaged axially with both ends of the roller 11 through the pair of connecting portions 21 and 22, and having the cover 27 for covering about a half of the outer periphery of the roller 11 between the pair of clasps 20, 20; the connecting portion 21 is divided longitudinally halfway to form a pair of divided connecting pieces 41, 41, and the connecting portion 22 is divided longitudinally halfway to form a pair of divided connecting pieces 42, 42; the cover 27, the pair of clasps 20, 20, the pair of divided connecting pieces 41, 41 protruding at one end of the clasps 20, 20, and the pair of divided connecting pieces 42, 42 protruding at the other end of the clasps 20, 20, are molded in one body of a synthetic resin; the cover 27 is made in a mesh form having a multitude of air holes 33; and the pair of the divided connecting pieces 41, 41 are connected with each other and the pair of the divided connecting pieces 42, 42 are also connected with each other by means of the connecting pieces 45 and 44 so that the cover 27 may be reversibly bent with elastic deformation along the outer periphery of the roller 11.

Furthermore, in the hair curler of the present invention having the roller 11, and the rectangular setting frame 19 including a pair of clasps 20, 20 for holding the roller 11 radially from both sides and a pair of connecting portions 21 and 22 for connecting the ends of the clasps 20, 20 with each other;. the setting frame being releasably engaged axially with both ends of the roller 11 through the pair of connecting portions 21 and 22, and having the cover 27 for covering about a half of the outer periphery of the roller 11 between the pair of clasps 20, 20; the pair of clasps 20, 20 and the pair of connecting portions 21 and 22 of the setting frame 19 are formed in one body; the cover 27 is integrally molded of a synthetic resin separately from the setting frame 19 and made in a mesh form having a multitude of air holes 33; and the outer end of the cover 27 is connected to the pair of clasps 20, 20 so that the cover 27 may be elastically bent with elastic deformation along the outer periphery of the roller 11.

In manufacturing the hair curler, therefore, there is no necessity to mold the cover 27 and the setting frame 19 by insert molding, enabling easy manufacture and assembling of the setting frame 19 and the cover 27. The cover 27 has good shape retention, so that the hair can be clasped well between the cover 27 and the roller 11. The cover 27, being reversible, can be bent to either side along the outer periphery of the roller 11. The hair, therefore, can be pressed smoothly against the roller 11, in the same state, with either side of the cover 27.

According to the present invention, the cover 27 and the pair of clasps 20, 20 of the setting frame 19 are molded in one body of a synthetic resin; the cover 27 is made in a form of mesh having a multitude of air holes 33; and the pair of clasps 20, 20 are connected to the pair of connecting portions 21 and 22 of the setting frame 19 so that the cover 27 will be reversibly bent with elastic deformation along the outer periphery of the roller 11. There is no necessity to mold the cover 27 and the setting frame 19 by insert molding. These parts can be manufactured and assembled with ease. In addition, the cover 27 has good shape retention, and therefore it is possible to hold the hair well between the cover 27 and the roller 11; that is, the hair rolled on the roller 11 can be securely held in the rolled state. Furthermore, the cover 27, being reversible, can be bent to either side along the outer periphery of the roller 11. The hair curler, therefore, can very easily be handled when a strand of hair is wound on the roller 11, thereby securely clasping the hair between the cover and the roller 11.

Furthermore, since the pair of clasps 20, 20 are rotatably connected to the pair of connecting portions 21 and 22 respectively around the longitudinal axis of the clasps 20, 20, the cover 27 can smoothly be turned back in the reverse direction of bending, thereby enabling easier handling.

Furthermore, since a pair of support shafts 29, 29 for connecting the ends of the pair of connecting portions 21 and 22 with each other are formed integral with the pair of connecting portions 21 and 22 and are inserted longitudinally into the pair of clasps 20, 20, it is possible to easily and securely install the pair of connecting portions 21 and 22, the pair of clasps 20, 20, and the cover 27.

The pair of clasps 20, 20 have insertion holes 31, 31 which are provided longitudinally for inserting the support shafts 29, 29 therein, and also have slits 32, 32 which continue from the outside surface of the clasps 20, 20 to the insertion holes 31, 31, and therefore the pair of support shafts 29, 29 can easily be inserted into the insertion holes 31, 31 through the slits 32, 32 from the outside surface of the clasps 20, 20, thereby enabling easy and secure installation of the pair of connecting portions 21 and 22, the pair of clasps 20, 20, and the cover 27.

At both ends of the pair of connecting portions 21 and 22 are provided retaining holes 39, 39, and at both ends of the pair of clasps 20, 20 are outwardly protrusively formed engaging pieces 40, 40, so that the pair of connecting portions 21 and 22, the pair of clasps 20, 20 and the cover 27 can easily and securely be installed by fitting the engaging pieces 40, 40 in the retaining holes 39, 39 of the connecting portions 21 and 22 in corresponding positions.

Furthermore, the connecting portion 21 is divided longitudinally halfway to form the pair of divided connecting pieces 41, 41, and the connecting portion 22 is also divided longitudinally halfway to form the pair of divided connecting pieces 42, 42; the cover 27, the pair of clasps 20, 20, the pair of divided connecting pieces 41, 41 protruding on one end of the clasps 20, 20, and the pair of divided connecting pieces 42, 42 protruding on the other end of the clasps 20, 20, are integrally formed of a synthetic resin; and the pair of divided connecting pieces 41, 41 are connected with each other and also the pair of divided connecting pieces 42, 42 are connected with each other by the connecting pieces 45 and 44 respectively. Therefore, similarly to the above-described, the setting frame 19 and the cover 27 can easily be manufactured and assembled without the above-described insert molding. Besides, the cover 27, having been improved in shape retention, can hold the hair well between the cover 27 and the roller 11. The hair rolled on the roller 11, therefore, is securely retained in the rolled state.

Furthermore, the pair of clasps 20, 20 and the pair of connecting portions 21 and 22 of the setting frame 19 are formed in one body; the cover 27 is integrally molded of a synthetic resin separately from the setting frame 19; and the outer ends of the cover 27 are connected to the pair of clasps 20, 20 so that the cover 27 may curve along the outer periphery of the roller 11. Therefore, similarly to the above-described, the setting frame 19 and the cover 27 can easily be manufactured and assembled without insert-molding. In addition since the cover 27 has better shape retention, the hair as-rolled on the roller 11 can be clasped securely between the cover 27 and the roller 11.

Furthermore, since hinges 34, 34 are provided between the cover 27 and the pair of clasps 20, 20, the reversion of the cover 27 in the direction of bending can be done more smoothly, thus allowing easier handling of the hair curler.

DESCRIPTION OF THE PREFERRED EMBODIMENTS

Figure 1:
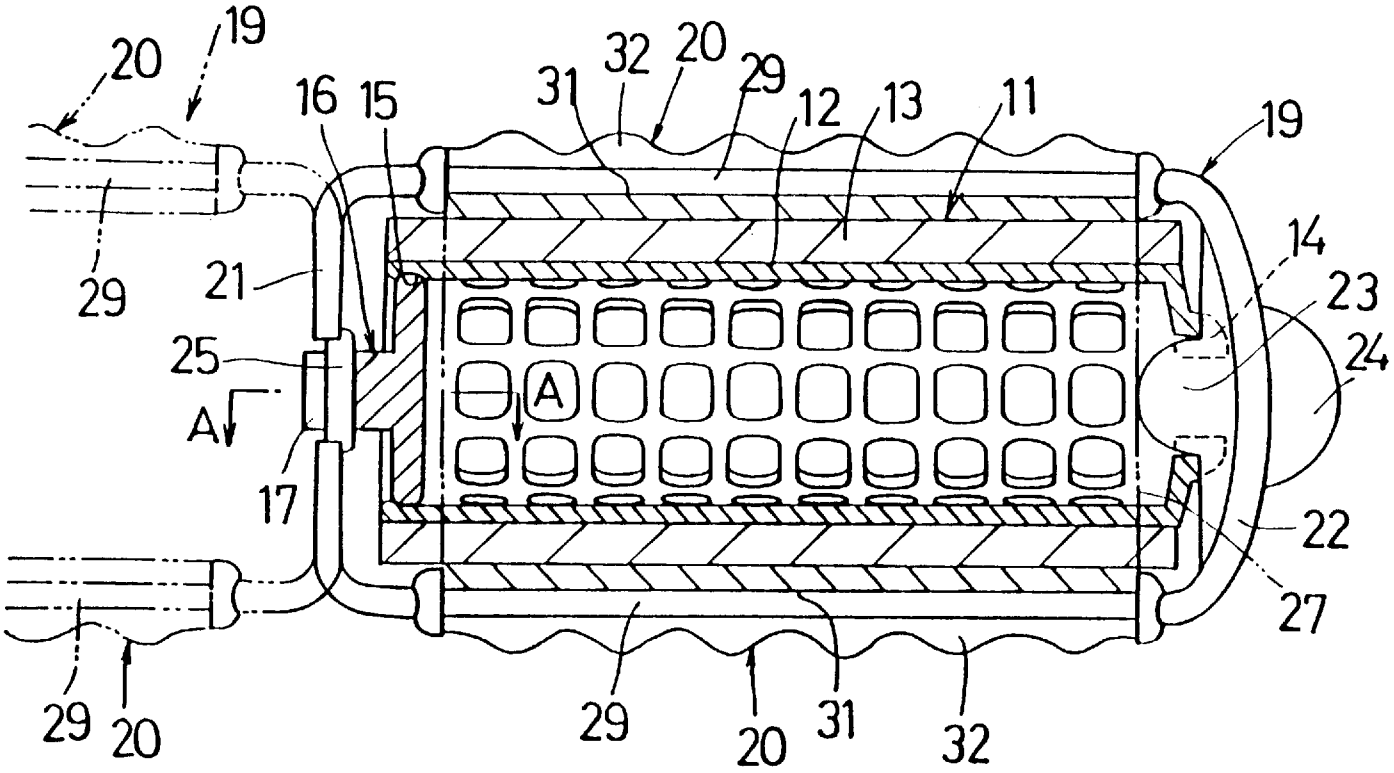
FIG. 1 is a front sectional view showing one embodiment of a hair curler according to the present invention.
Figure 2:
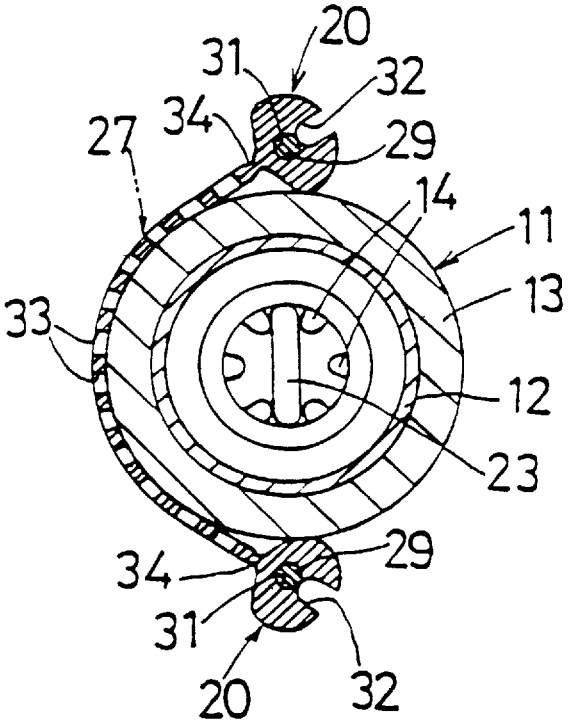
FIG. 2 is a side sectional view of the same.
Figure 3:
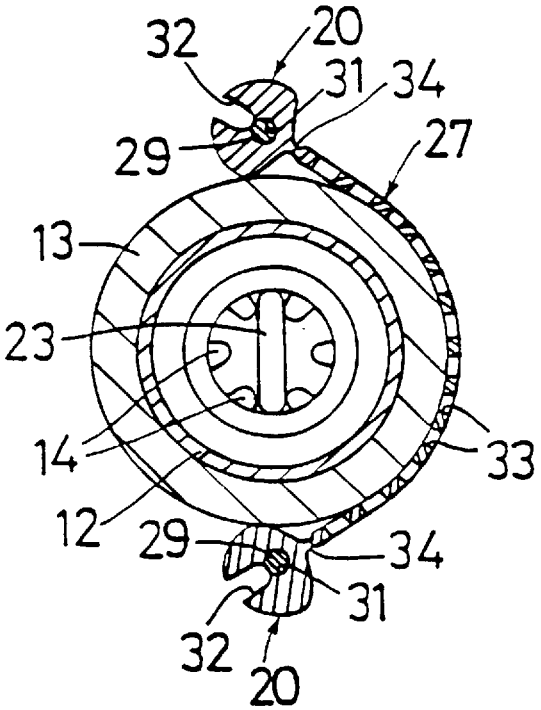
FIG. 3 is a side sectional view of a cover of the same in a reversed state.
Figure 4:
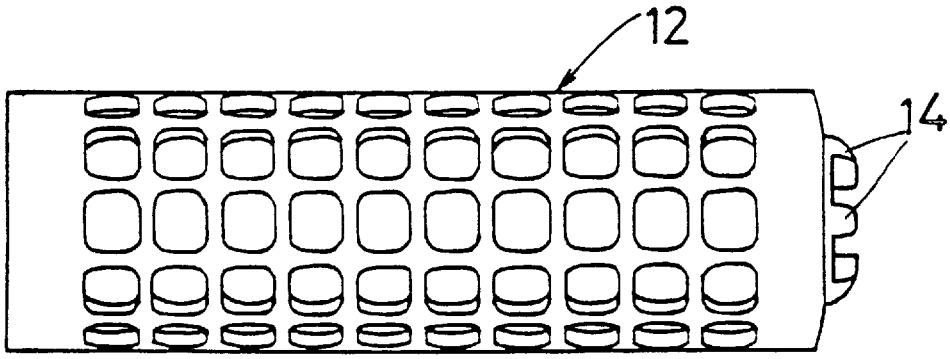
FIG. 4 is a front view of a core cylinder of the same.
Figure 5:
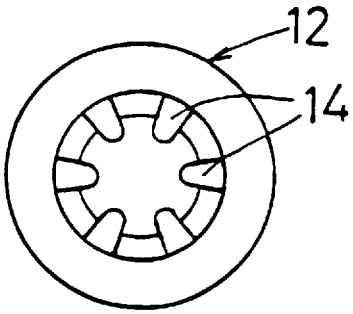
FIG. 5 is a side view of the core cylinder.
Figure 6:
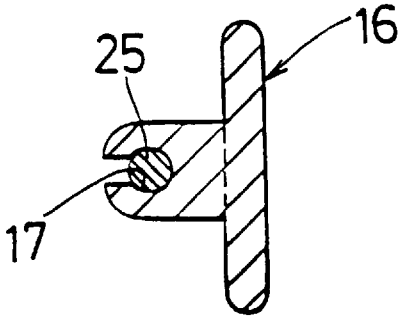
FIG. 6 is a sectional view taken along line A—A of FIG. 1.

Hereinafter an embodiment of a hair curler according to the present invention will be explained with reference to the accompanying drawings. In FIGS. 1 to 3, a reference numeral 11 denotes a roller, which comprises a core cylinder 12 produced of a synthetic resin in a form of cage-like cylinder and an outer skin 13 of a foamed synthetic resin fitted on the core cylinder 12. As shown in FIGS. 4 and 5, a tooth-shaped setting frame retaining portion 14 is formed on the whole circumference of one end of the core cylinder 12. In the inner surface of the other end of the core cylinder 12 is provided an annular groove 15, in which a setting frame retainer 16 produced of a synthetic resin is rotatably fitted to rotate about the axis of the core cylinder 12. The setting frame retainer 16 is provided with a retaining groove 17 as shown in FIG. 6.

Figure 7:
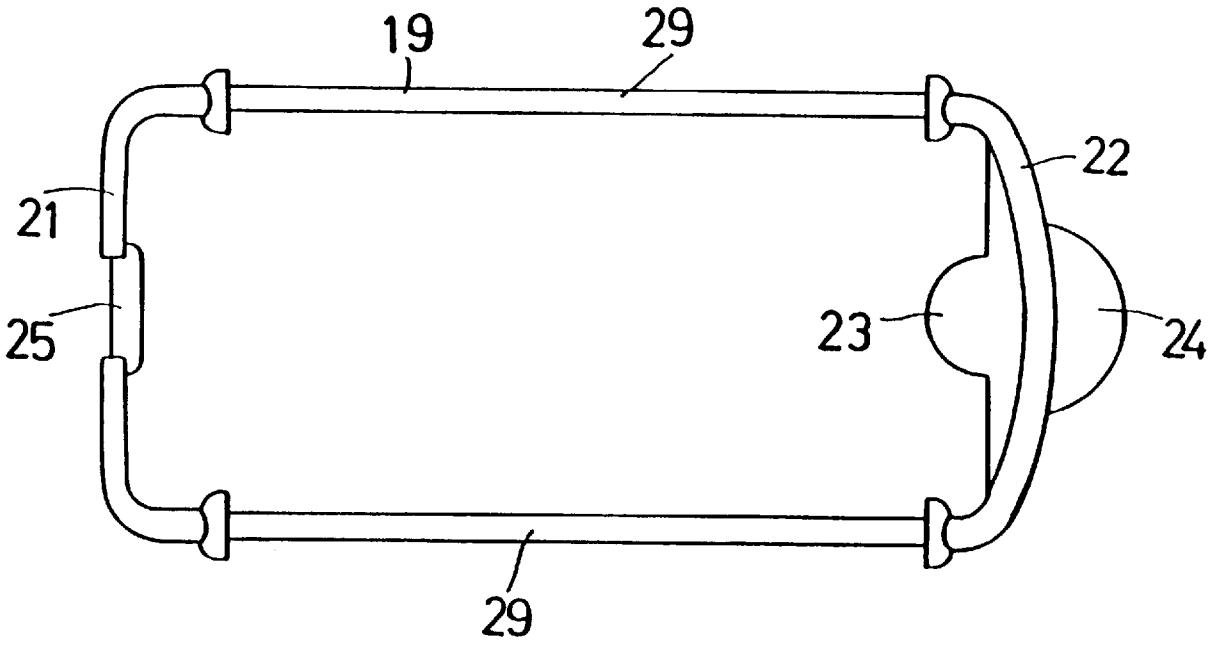
FIG. 7 is a front view of connecting portions and support shafts of the same.

A reference numeral 19 is a setting frame, which is formed in a rectangular shape of a pair of clasps for clasping a strand of hair radially from both sides, and connecting portions 21 and 22 for connecting opposite ends of the clasps 20, 20 with each other. At center inside of one connecting portion 22 is provided an engaging lug 23 which engages in the core cylinder 12 as shown in FIG. 7; and on the outside of this engaging lug 23 is protrusively provided a finger grip 24. The connecting portion 22 is designed to be releasably engaged with recesses of the setting frame retaining portion 14. At the center of the other connecting portion 21 is formed an engaging portion 25 as shown in FIG. 7. This engaging portion 25 is fitted in the retaining groove 17 of the setting frame retainer 16, whereby the connecting portion 21 is releasably engaged with the core cylinder 12 and rotatably about the axis of the core cylinder 12, through the engaging portion 25 and the setting frame retainer 16. The engaging portion 25 is rotatable about the axis in the radial direction of the roller 11 relative to the setting frame retainer 16.

A reference numeral 27 denotes a cover disposed between the pair of clasps 20, 20, covering generally the entire length of about a half of the outer periphery of the roller 11.

As shown in FIG. 7, the frame 19 is provided with the pair of support shafts 29, 29 for connecting the opposite ends of the pair of connecting portions 21 and 22 with each other. The pair of connecting portions 21 and 22 and the pair of support shafts 29, 29 are integrally formed of a synthetic resin such as polyethylene.

Figure 8:
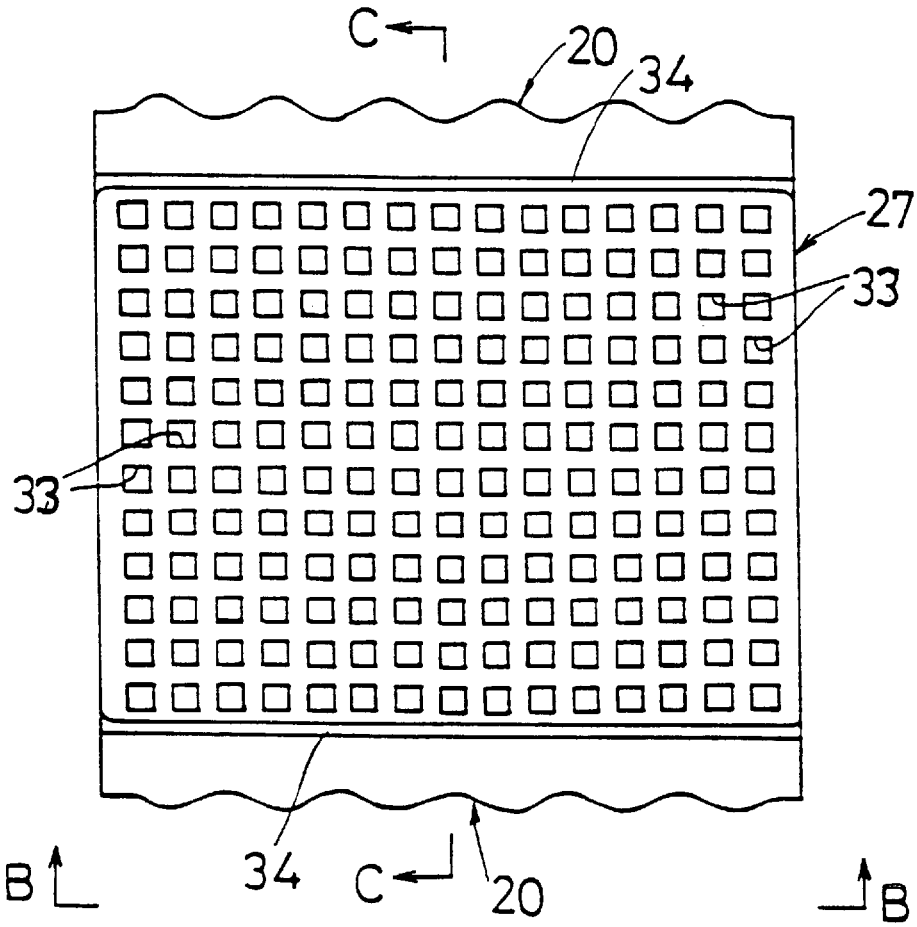
FIG. 8 is a front of clasps and a cover of the same.
Figure 9:
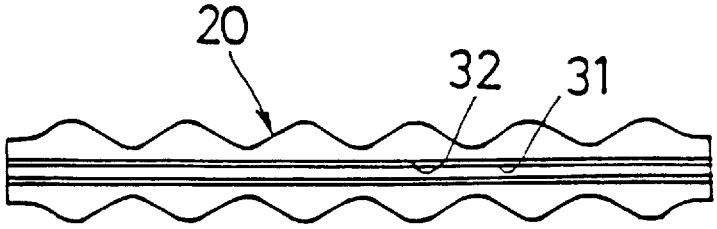
FIG. 9 is a perspective view taken along line B—B of FIG. 8.
Figure 10:
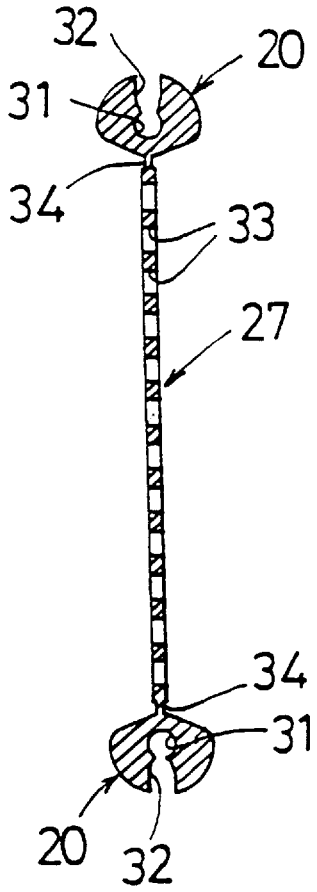
FIG. 10 is a sectional view taken along line C—C of FIG. 8.
Figure 11:
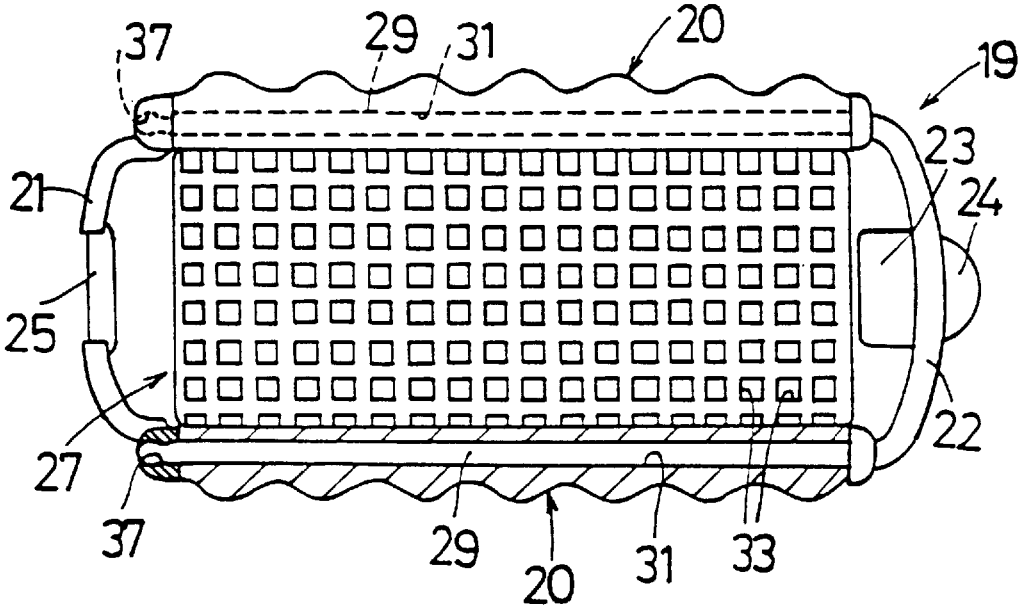
FIG. 11 is a partially cutaway front sectional view of a setting frame and cover of another embodiment.
Figure 12:
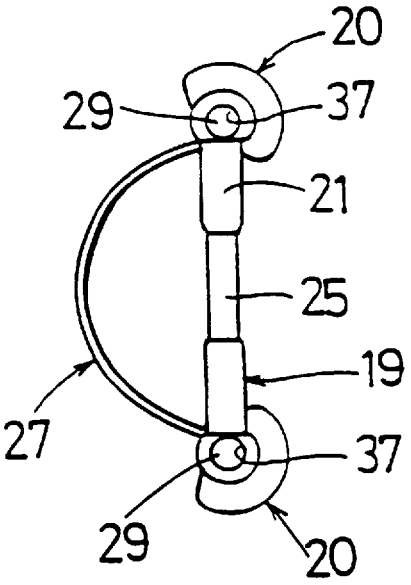
FIG. 12 is a side view of the setting frame and cover.
Figure 13:
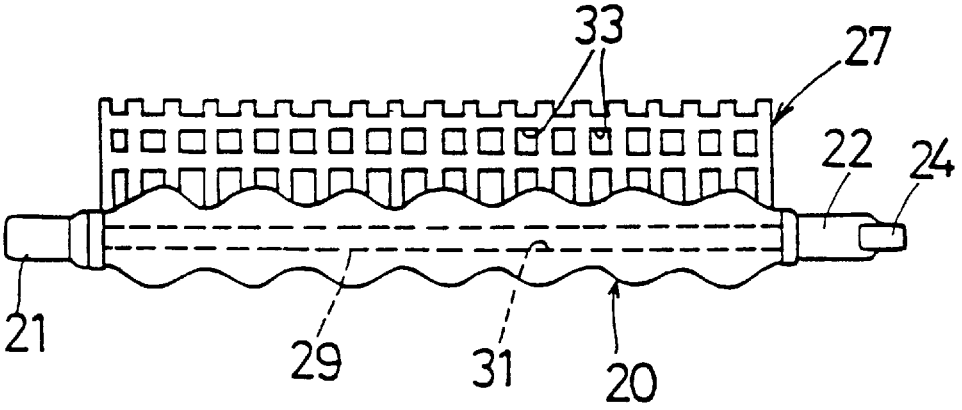
FIG. 13 is a bottom view of the setting frame and cover.
Figure 14:
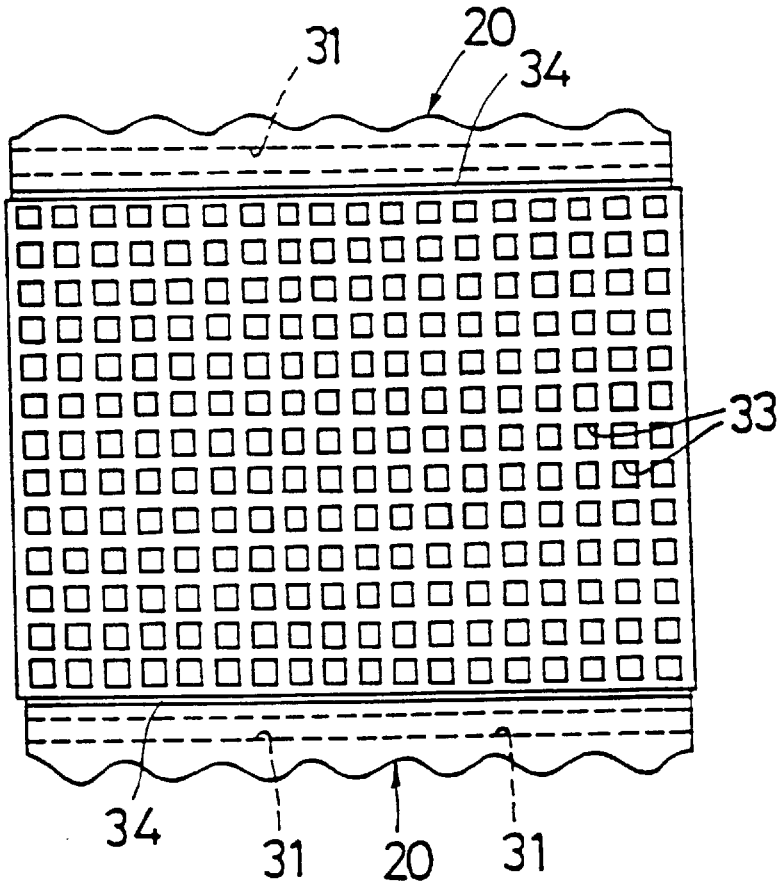
FIG. 14 is a front view of the clasp and the cover.
Figure 15:
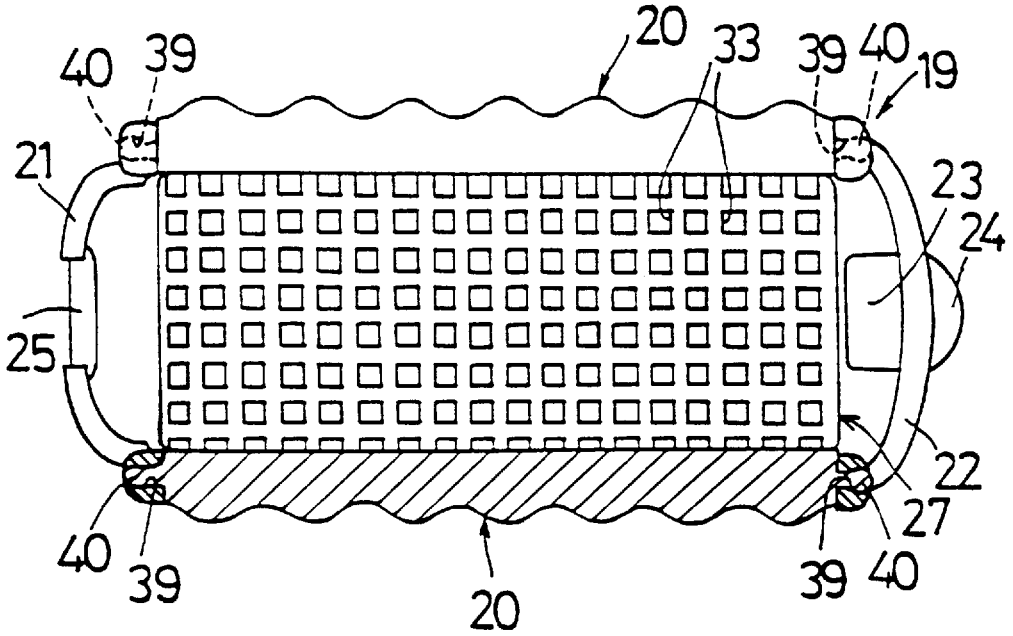
FIG. 15 is a partially cutaway front sectional view of a setting frame and cover of another embodiment.
Figure 16:
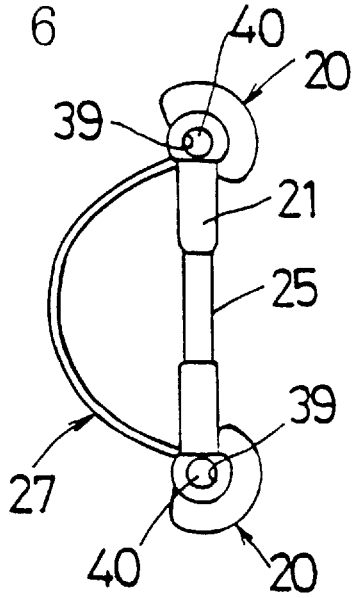
FIG. 16 is a side view of the setting frame and cover.
Figure 17:
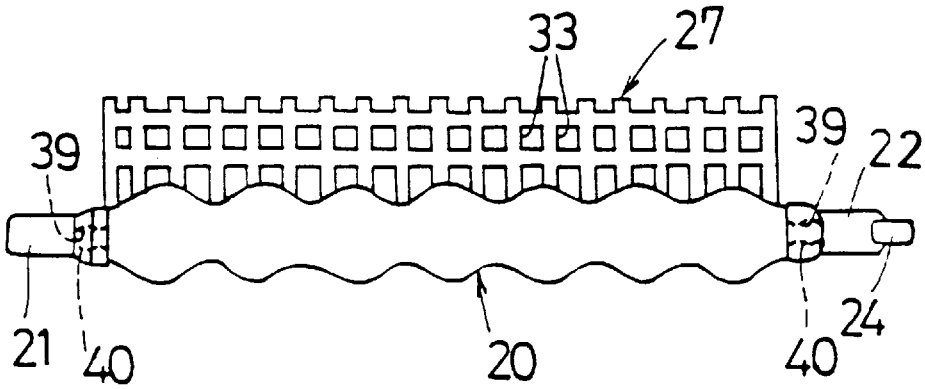
FIG. 17 is a bottom view of the setting frame and cover.
Figure 18:
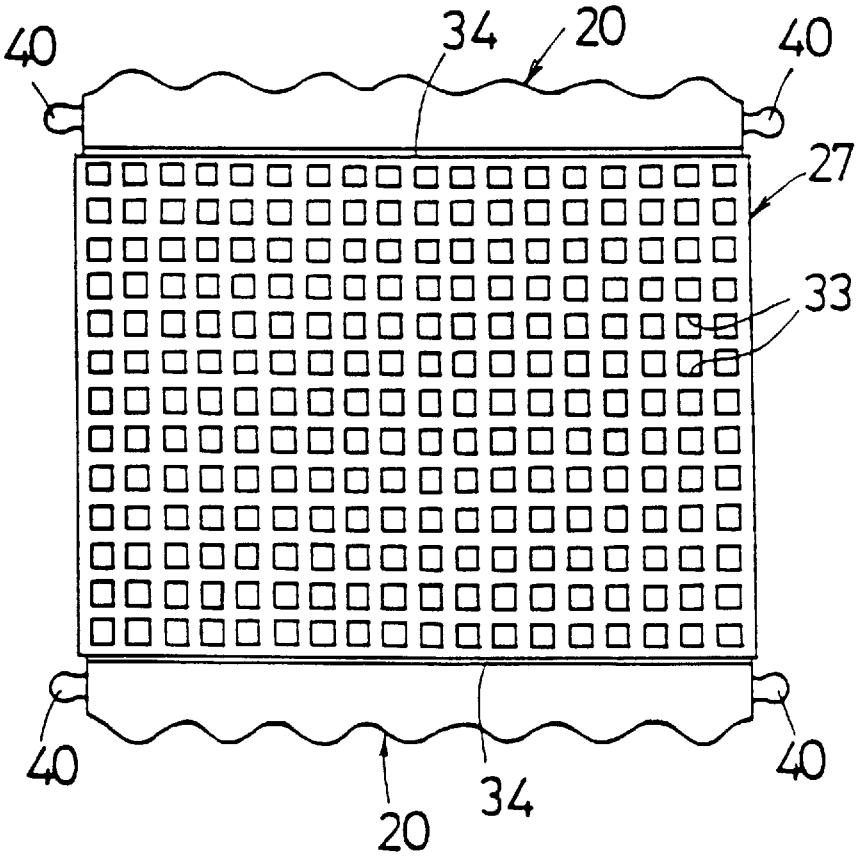
FIG. 18 is a front view of the clasp and cover.
Figure 19:
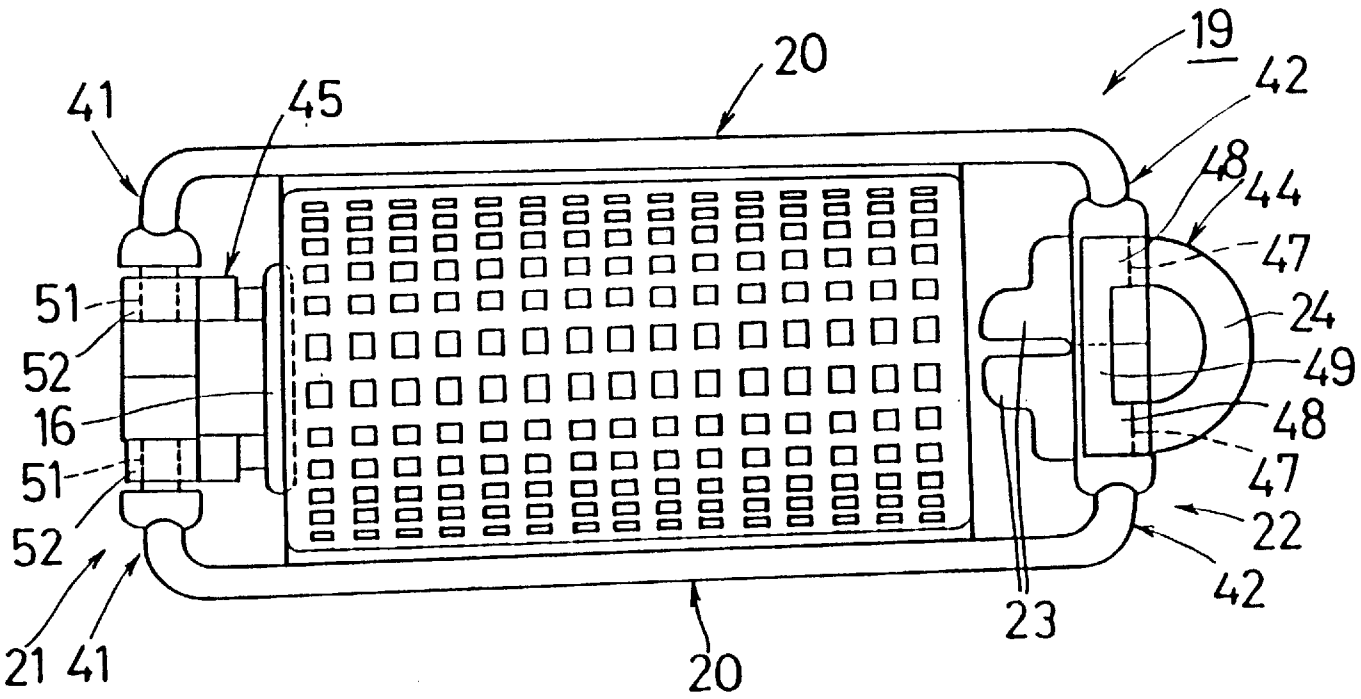
FIG. 19 is a front view of a setting frame and cover of another embodiment.
Figure 20:
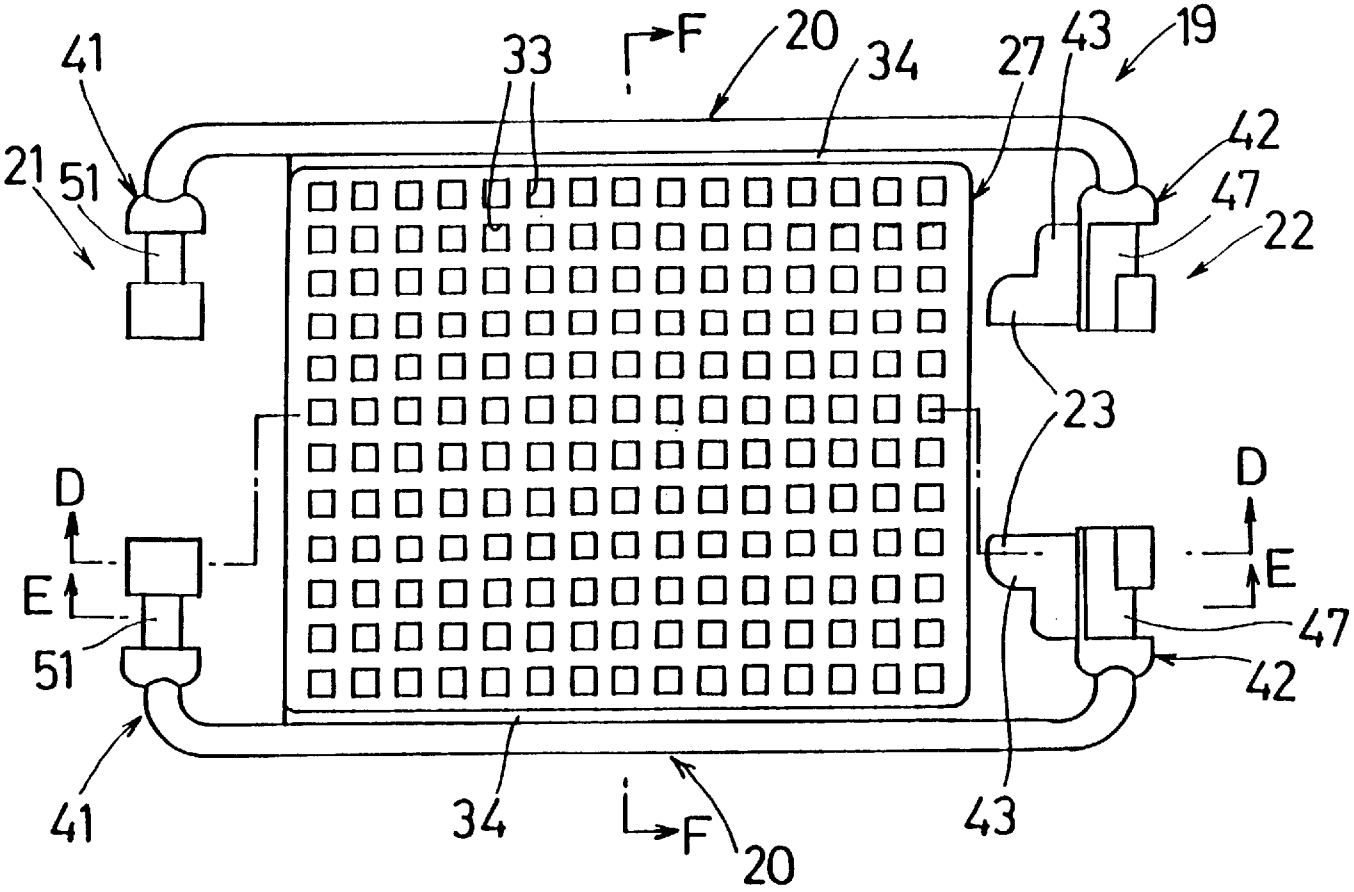
FIG. 20 is a front view of the setting frame and cover in a developed state.
Figure 21:
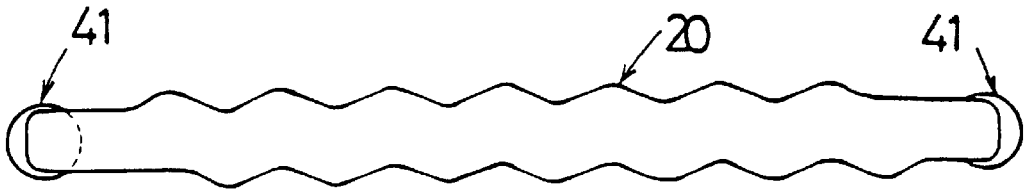
FIG. 21 is a bottom view of the setting frame and cover.
Figures 22A, 22B, 22C:
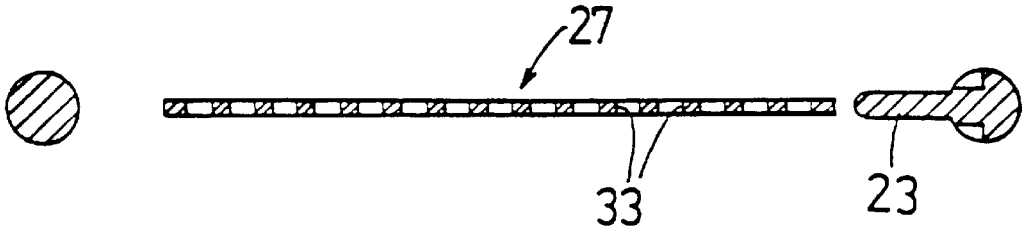
FIG. 22 is a sectional view taken along line D—D of FIG. 20.
Figures 23A, 23B, 23C:
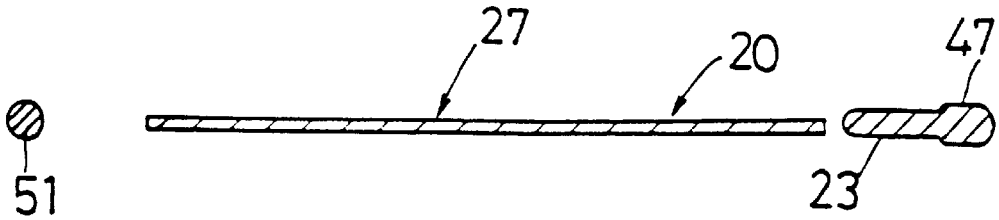
FIG. 23 is a sectional view taken along line E—E of FIG. 20.
Figure 24:
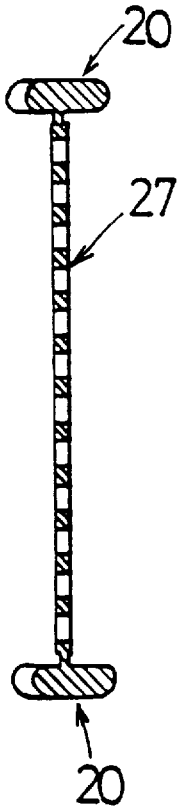
FIG. 24 is a sectional view taken along line F—F of FIG. 20.

As shown in FIGS. 8 to 10, the cover 27 and the pair of clasps 20, 20 of the setting frame 19 are integrally molded of a synthetic resin such as polyethylene, and the insertion holes 31, 31 for inserting the support shafts 29, 29 are longitudinally formed through in the pair of clasps 20, 20; and also the slits 32, 32 are formed through from the outer peripheral surface of the clasps 20, 20 to the insertion holes 31, 31. The pair of support shafts 29, 29 are inserted into the insertion holes 31, 31 from the outer peripheral surface of the clasps 20, 20 through the slits 32, 32 as shown in FIGS. 1 to 3, whereby the pair of clasps 20, 20 are rotatably connected to the pair of connecting portions 21 and 22 to thereby rotate about the longitudinal axis (the support shaft 29) of the clasps 20, 20. Thus connecting the pair of clasps 20, 20 with the pair of connecting portions 21 and 22 respectively allows the cover 27 to reversibly bend with elastic deformation along the outer periphery of the roller 11.

As shown in FIGS. 8 to 10, the cover 27 is made in a mesh form having a multitude of square air holes 33, and also is formed thin; between the pair of clasps 20, 20 and the cover 27 are formed thin hinge portions 34, 34, so that, with the rotation of the clasps 20, 20 about the support shaft 29 and the bending of the hinge portions 34, 34, the cover 27 is designed to be rotatably bent with elastic deformation, that is, to be bent from either side along the outer periphery of the roller 11 as shown in FIGS. 2 and 3.

In the above-described embodiment, when the hair curler assembled as shown in FIGS. 1 to 3 is used for curling the hair, first the finger grip 24 of the setting frame 19 is gripped with fingers and pulled outwardly in an axial direction. The setting frame 19, when pulled, extends with elastic deformation until the engaging lug 23 comes off from the setting frame retainer 16. Then, the setting frame 19 is swung reversely on the fulcrum of the engaging portion 25 as indicated by a chain line in FIG. 1 until the setting frame 19 is in line with the roller 11. Subsequently, the setting frame 19 together with the roller 11 is held by one hand and the roller 11 is lightly pressed to the hair. In this state, a strand of hair is rolled on the roller 11 while turning the roller 11. After hair rolling is finished, the setting frame 19 is turned on the fulcrum of the engaging portion 25 to the setting frame retaining portion 14 side, and the engaging lug 23 is engaged with the setting frame retaining portion 14. At this time, the hair rolled on the roller 11 is being held from both sides between the roller 11 and the clasps 20, 20 of the setting frame 19. Therefore, the hair rolled on the roller 11 can be clasped securely and neatly without appearing radially outwardly of the roller 11 even in the case of gradation-cut hair.

Since either side of the cover 27 is usable in the same state on the roller 11, it is possible to press the hair smoothly on the outer skin 13 of the roller 11 and accordingly to easily engage the setting frame 19 with the setting frame retaining portion 14 of the roller 11, thereby enabling very easy handling of the hair curler and winding a strand of hair on the setting frame retaining portion 14 of the roller 11.

FIGS. 11 to 14 show another embodiment, wherein the pair of support shafts 29, 29 are provided to connect the opposite ends of the pair of connecting portions 21 and 22 with each other; and one connecting portion 22 and the pair of support shafts 29, 29 are formed in one body of such a synthetic resin as polyethylene, while the other connecting portion 21 is formed of a synthetic resin such as polyethylene, separately from the connecting portion 22 and the pair of support shafts 29, 29. At both ends of the other connecting portion 21 are provided retaining holes 37, 37.

The cover 27 and the pair of clasps 20, 20 are molded in one body of a synthetic resin such as polyethylene, and the insertion holes 31, 31 are formed longitudinally through in the clasps 20, 20. However; the clasps 20, 20 are not provided with the slits 32, 32; the pair of support shafts 29, 29 are inserted into the insertion holes 31, 31 from one end of the clasps 20, 20; and the forward ends of the support shafts 29, 29 protruding from the other ends of the clasps 20, 20 are fitted in the retaining holes 37, 37 to connect the pair of support shafts 29, 29 to both ends of the other connecting portion 21, whereby the pair of clasps 20, 20 are rotatably connected to the pair of connecting portions 21 and 22 so as to turn about the longitudinal axis (the support shaft 29) of the clasps 20, 20. The hair curler is similar in other respects of constitution to the above-described embodiment.

FIGS. 15 to 18 show another embodiment, in which the pair of support shafts 29, 29 are not provided for connecting the opposite ends of the pair of connecting portions 21 and 22; the pair of connecting portions 21 and 22 are formed separately of a synthetic resin such as polyethylene. In both ends of the pair of connecting portions 21 and 22 are provided retaining holes 39, 39.

The cover 27 and the pair of clasps 20, 20 are integrally formed of a synthetic resin such as polyethylene; and on both ends of the pair of clasps 20, 20 are outwardly protrusively provided engaging pieces. When the engaging pieces 40, 40 are fitted in the retaining holes 39, 39 of the connecting portions 21 and 22 in corresponding positions, the pair of clasps 20, 20 are rotatably connected to the pair of connecting portions 21 and 22 so as to rotate about the longitudinal axis (the engaging piece 40) of the clasps 20, 20. Connecting the pair of clasps 20 with the pair of connecting portions 21 and 22 makes the cover 27 bendable along the outer periphery of the roller 11. Thus the pair of clasps 20, 20 are connected to the pair of connecting portions 21 and 22, thereby allowing the cover 27 to bend along the outer periphery of the roller 11. The present embodiment is similar in other respects of constitution to the embodiment described above.

In the embodiment of FIGS. 15 to 18, the retaining holes 39, 39 are provided in both ends of the pair of connecting portions 21 and 22; and the engaging pieces 40, 40 are formed outwardly protrusively on both ends of the pair of connecting portions 21 and 22. Reversely to this, the hair curler may be designed such that the retaining holes 39, 39 are provided in both ends of the pair of clasps 20, 20; engaging pieces 40, 40 are outwardly protrusively provided on both ends of the pair of connecting portions 21 and 22; and the engaging pieces 40, 40 are fitted respectively in the retaining holes 39, 39 of the clasps 20, 20 in corresponding positions, whereby the pair of clasps 20, 20 are rotatably connected to the pair of connecting portions 21 and 22 so as to rotate about the longitudinal axis of the clasp 20.

FIGS. 19 to 30 show another embodiment. As shown in FIGS. 19 to 24, the pair of connecting portions 21 and 22 are divided halfway in the longitudinal direction to form the pair of divided connecting pieces 41, 41 and the pair of divided connecting pieces 42, 42 respectively. On the pair of divided connecting pieces 42, 42 constituting the connecting portion 22 are integrally formed a pair of divided engaging lugs 43, 43 which constitute the engaging lug 23. The connecting piece 44 having the finger grip 24 is formed of a synthetic resin such as polyethylene, separately from the pair of divided connecting pieces 42, 42.

Figure 25:
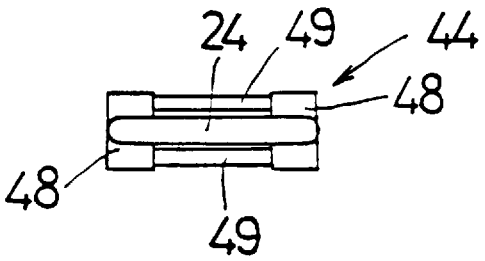
FIG. 25 is a plan view of a connecting piece 44.
Figure 26:
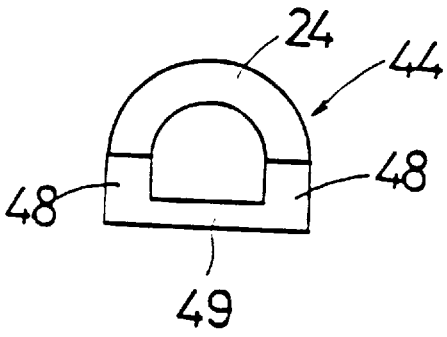
FIG. 26 is a front view of the connecting piece 44.
Figure 27:
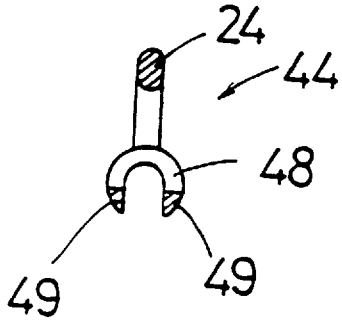
FIG. 27 is a side sectional view of the connecting piece 44.

The connecting piece 44 is for connecting the pair of divided connecting pieces 42, 42,. and is made of a synthetic resin such as polyethylene. As shown in FIGS. 25 to 27, the connecting piece 44 has, beside the finger grip 24, a pair of U-shaped engaging portions 48, 48 which engage with recesses 47, 47 of the pair of divided connecting pieces 42, 42, and a pair of connecting portions 49, 49 connecting a pair of engaging portions 48, 48. The pair of divided connecting pieces 42, 42 are connected with each other by engaging the pair of engaging portions 48, 48 with the recesses 47, 47 of the divided connecting pieces 42, 42.

Furthermore, there is provided a connecting piece 45 for connecting the pair of divided connecting pieces 41, 41 of the connecting portions 21 with each other; the setting frame retainer 16 is formed integral with the connecting piece 45.

Figure 28:
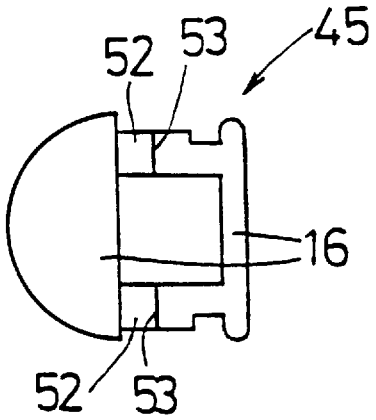
FIG. 28 is a plan view of a connecting piece 45.
Figure 29:
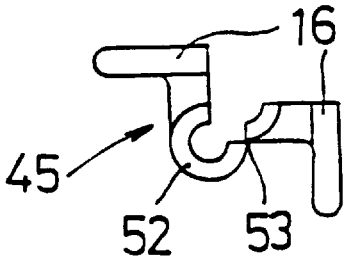
FIG. 29 is a front view of the connecting piece 45.
Figure 30:
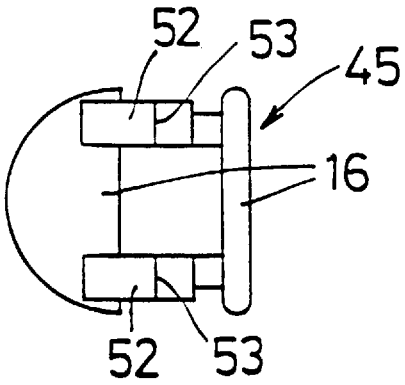
FIG. 30 is a bottom view of the connecting piece 45.
Figure 31:
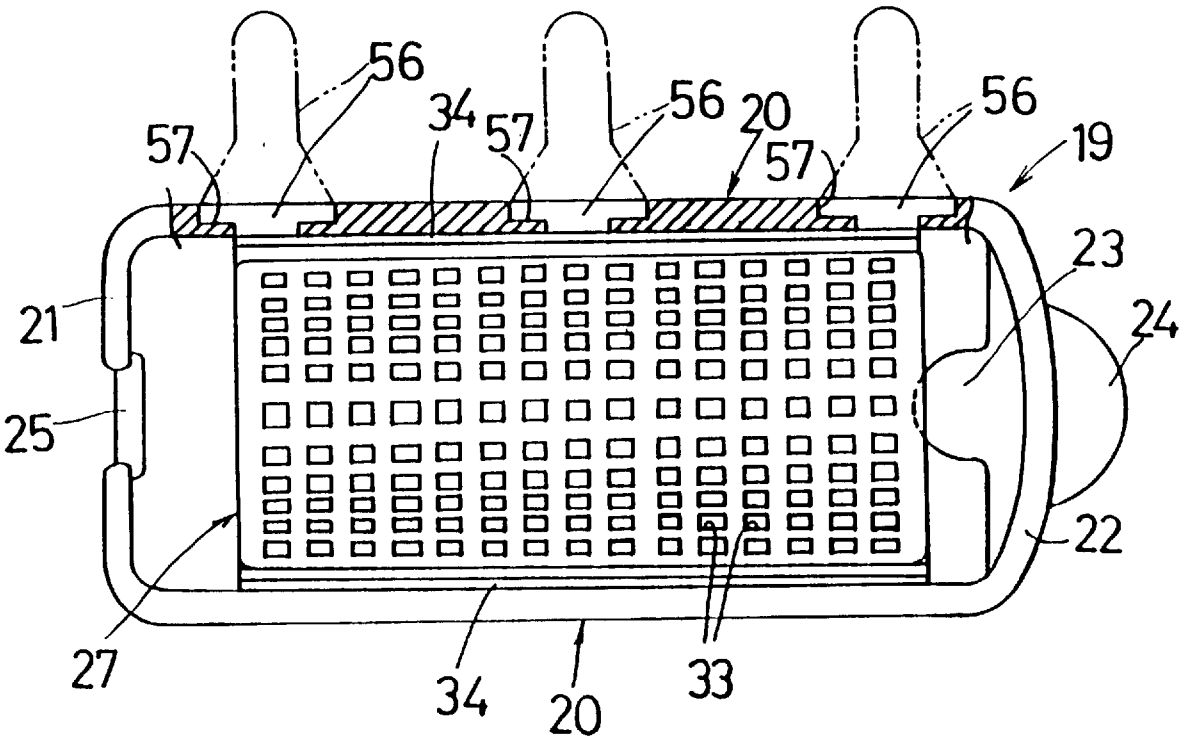
FIG. 31 is a partially cutaway front sectional view of a setting frame and cover of another embodiment.
Figure 32:
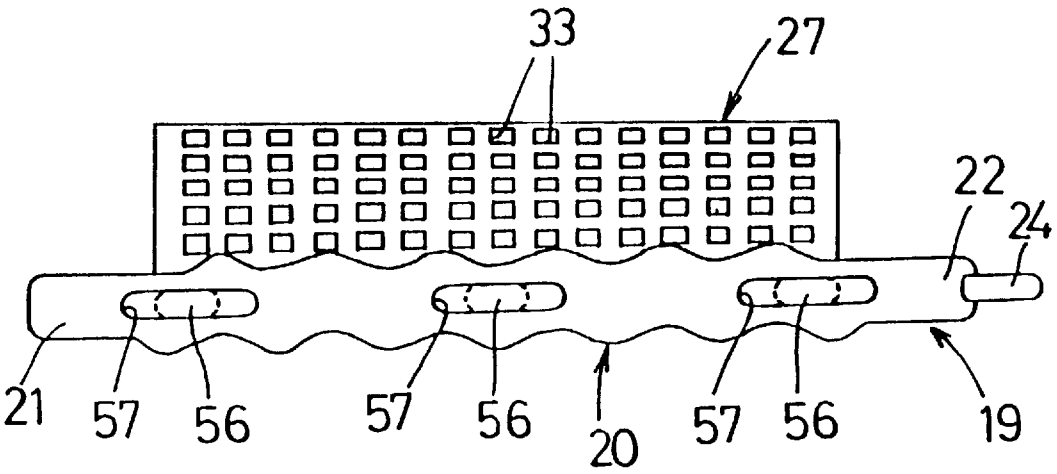
FIG. 32 is a bottom view of the setting frame and cover.
Figure 33:
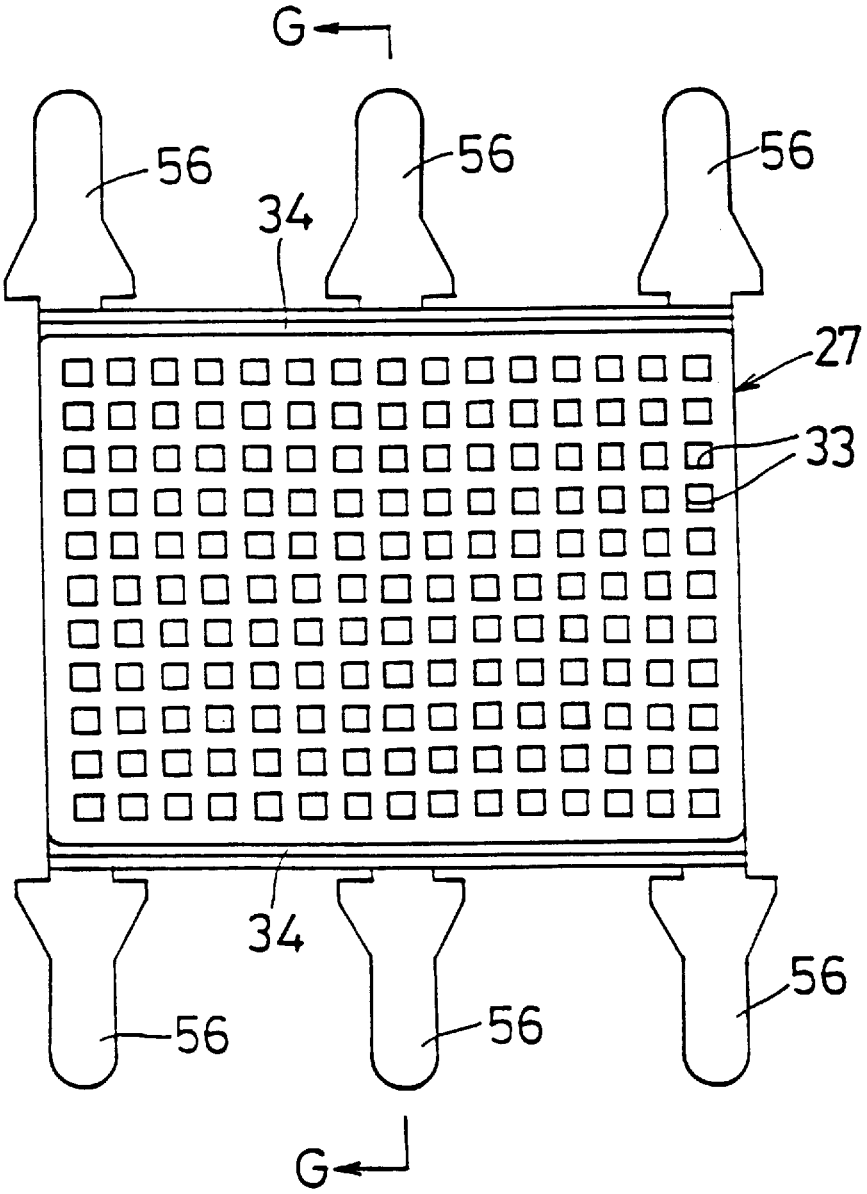
FIG. 33 is a front view of the cover.
Figure 34:
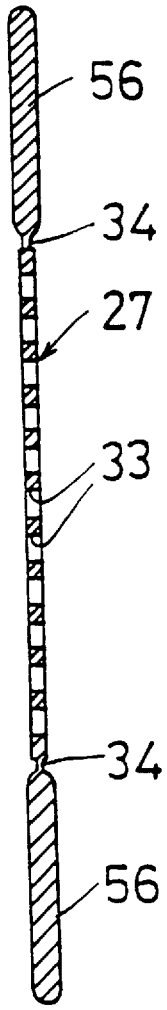
FIG. 34 is a sectional view taken along line G—G of FIG. 33.

The connecting piece 45 is produced of a synthetic resin such as polyethylene. As shown in FIGS. 28 to 30, this connecting piece 45 has a pair of cylinder portions 52, 52 which fit on the small-diameter portions 51, 51 of the divided connecting pieces 41, 41 (see FIG. 20), and a hinge portion 53, whereby the cylinder portions 52, 52 can be opened and closed. The cylinder portions 52, 52 in an opened state are fitted on the small-diameter portions 51, 51 of the divided connecting pieces 41, 41 (see FIG. 20). After the cylinder portions 52, 52 are closed, the setting frame retainer 16 divided into a split form is engaged in the annular groove 15 of the core cylinder 12 of the roller 11 (see FIG. 1); thus the pair of divided connecting pieces 41, 41 of the connecting portion 21 can be held as connected with each other, with the cylinder portions 52, 52 held as closed. In this case, the connecting portion 21 becomes rotatable about the axis of the core cylinder 12 through the setting frame retainer 16, and also rotatable about the radial axis (the small-diameter portion 51) of the roller 11 relative to the setting frame retainer 16.

Subsequently, the pair of divided connecting pieces 42, 42 are connected with each other by the connecting piece 44, and also the pair of divided connecting pieces 41, 41 are connected with each other by the connecting piece 45, thereby so that the cover 27 will be reversibly bent with elastic deformation along the outer periphery of the roller 11. The present embodiment is similar in other respects of constitution as the above-described embodiment.

FIGS. 31 to 34 shown another embodiment, wherein the pair of clasps 20, 20 of the setting frame 19 and the pair of connecting portions 21 and 22 are integrally formed of a synthetic resin such as polyethylene, and the cover 27 is integrally molded of a synthetic resin such as polyethylene, separately from the setting frame 19. On both ends of the cover 27 are protrusively formed a plurality of fitting pieces 56 through the hinge portions 34, 34, and the pair of clasps 20, 20 are provided with a plurality of fitting holes 57 correspondingly to the fitting pieces 56. Then, with the fitting pieces 56 of the cover 27 fitted in the fitting holes 57 of the clasps 20, 20, the forward end side of the fitting pieces 56 outwardly protruding out of the fitting holes are cut off as indicated by a chain line in FIG. 31. Thus the outer end of the cover is connected to the pair of clasps 20, 20 such that the cover 27 will bend along the outer periphery of the roller 11. The present embodiment is similar in other respects of constitution to the above-described embodiment.

Figure 35:
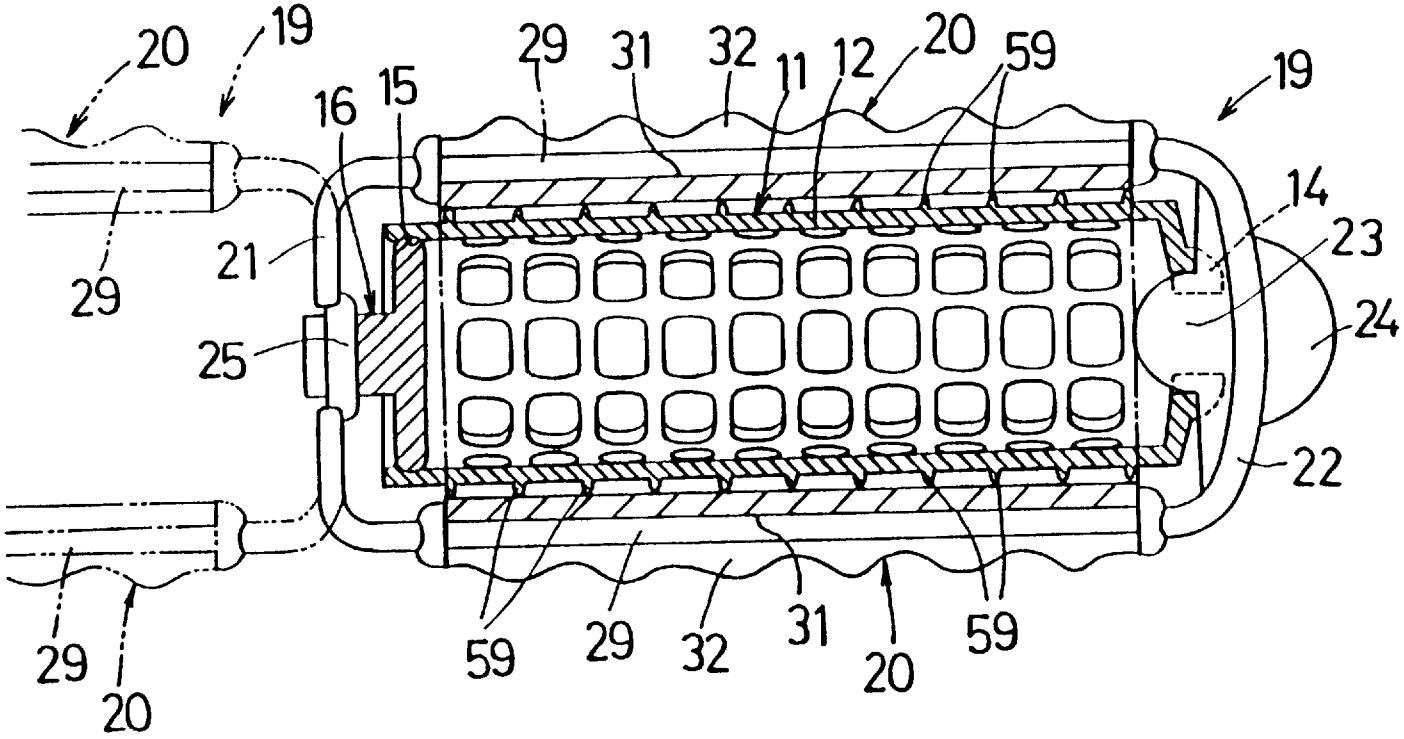
FIG. 35 is a front sectional view showing another embodiment.
Figure 36:
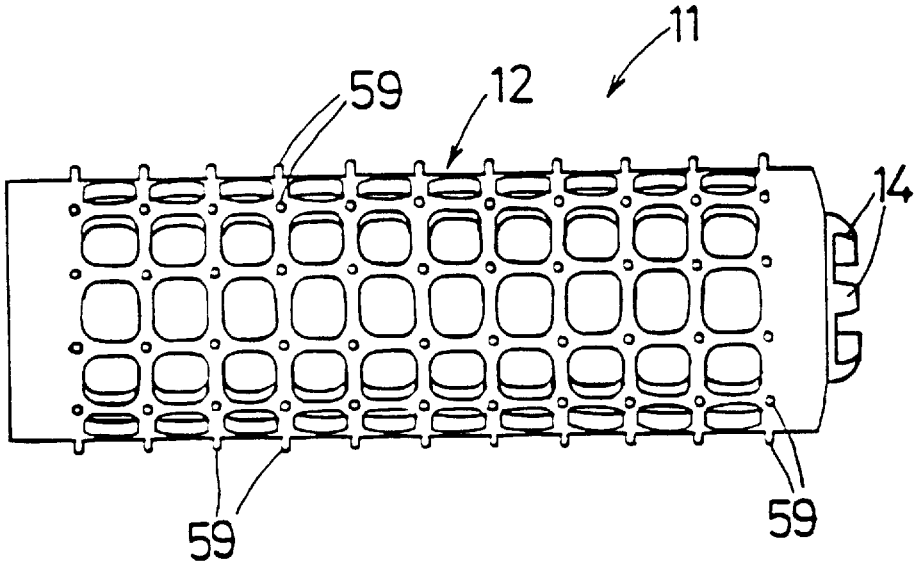
FIG. 36 is a front view of a roller of the same.
Figure 37:
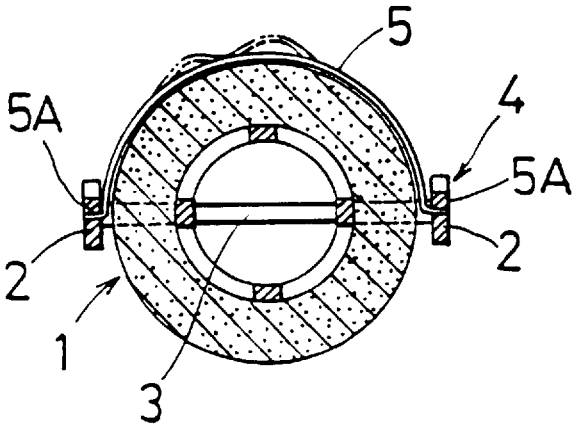
FIG. 37 PRIOR ART
FIG. 37 is a sectional view showing a conventional example.
Figure 38:
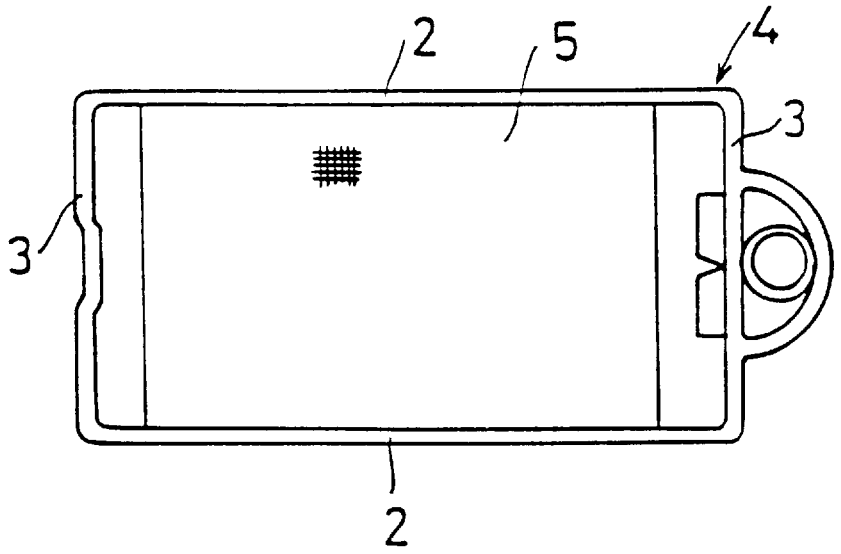
FIG. 38 PRIOR ART
FIG. 38 is a front view of a setting frame to which the cover is fixedly attached.
Figure 39:
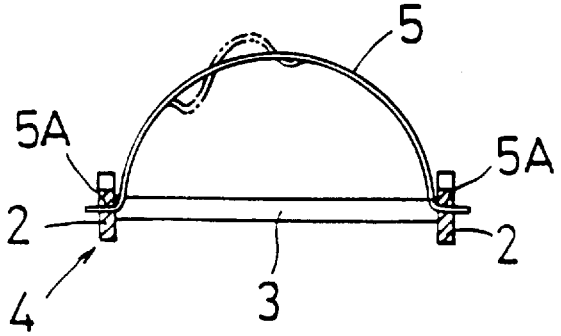
FIG. 39 PRIOR ART
FIG. 39 is a sectional view of the setting frame.
Figure 40:
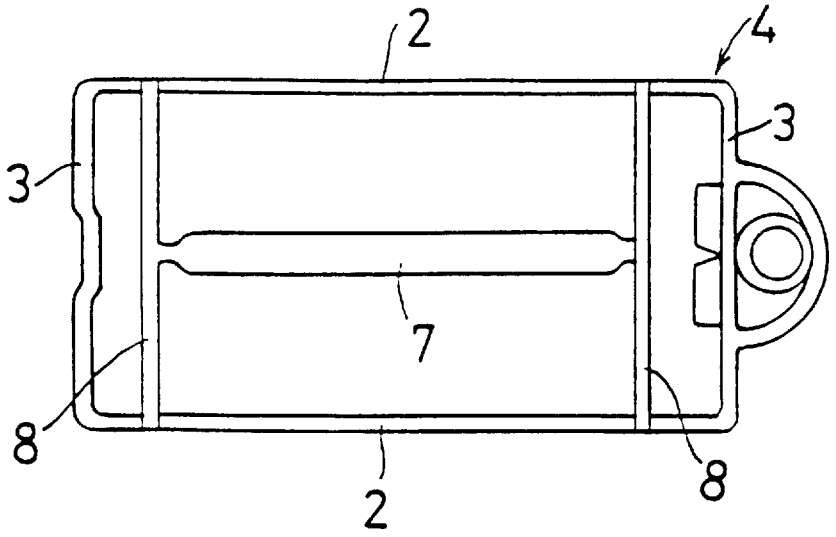
FIG. 40 PRIOR ART
FIG. 40 is a sectional view showing another conventional example.
Figure 41:
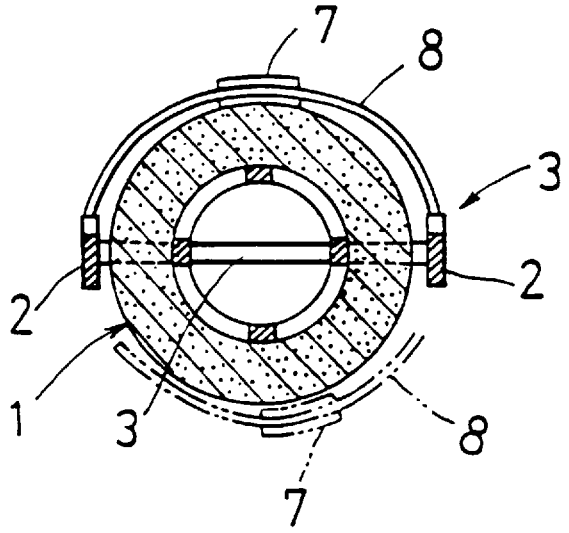
FIG. 41 PRIOR ART
FIG. 41 is a front view of the setting frame.

In the above-described embodiment, the roller 11 comprises the core cylinder 12 and the outer skin 13, and the roller 11 is not limited thereto and may be of any type of constitution if it is of a roller form. For example, as shown in FIGS. 35 and 36, the roller 11 may be constituted only of a core cylinder 12 produced of a relatively soft material, and a multitude of non-slip projections 59 may be provided on the outer periphery of the core cylinder 12.

Furthermore, in the above-described embodiment, the hinge portions 34, 34 provided between the cover 27 and the pair of clasps 20 are formed thinner than the cover 27, but may be formed to the same thickness as the cover 27 if easily bendable.

Furthermore, in the above-described embodiment, the multitude of air holes 33 of the cover 27 are square, but the shape of the air holes 33 is not limited thereto and may be any of round, triangular, rhombic, and other forms.

Industrial Applicability

The present invention is useful because of easy manufacture and assembling of the setting frame and cover. Also the present invention is useful because of its easy handling and effective holding of the hair between the cover and the roller.

I claim:

1. A hair curler comprising:

a roller having an outer circumferential surface and opposite axial ends;

a rectangular setting frame including a pair of clasps for clasping hair between each of said pair of clasps and said outer circumferential surface of said roller and a pair of connecting portions for connecting said clasps to form a rectangular shape;

said setting frame being releasably engaged with said axial ends of said roller through said pair of connecting portions;

a cover for covering about a half of said outer circumferential surface of said roller between said pair of clasps, said cover comprising a synthetic resin layer extending between said clasps and capable of covering said outer circumferential surface;

said cover and said pair of clasps of said setting frame being integrally molded of a synthetic resin;

said cover being made in a form of mesh having a multitude of air holes; and said pair of clasps being connected to said pair of connecting portions of said setting frame respectively so that said cover is reversibly bendable with elastic deformation along said outer circumferential surface of said roller;

wherein said clasps have longitudinal axes and said pair of clasps are rotatably connected to said pair of connecting portions so as to turn about the longitudinal axes of said clasps.

2. A hair curler as defined in claim 1, wherein said setting frame has a pair of support shafts formed integrally with said pair of connecting portions so as to connect ends of said pair of connecting portions with each other, and said pair of support shafts are inserted longitudinally in said pair of clasps so that said pair of clasps are rotatably connected to said pair of connecting portions so as to turn about the longitudinal axes of said clasps.

3. A hair curler as defined in claim 2, wherein said pair of clasps which have outside surfaces are provided with insertion holes in longitudinal directions of said pair of clasps for inserting said support shafts, and also provided with slits formed from the outside surfaces of said clasps to said insertion holes, and said pair of support shafts are inserted through said slits to said insertion holes from the outside surfaces of said clasps.

4. A hair curler as defined in claim 3, wherein hinge portions are provided between said cover and said pair of clasps.

5. A hair curler as defined in claim 2, wherein hinge portions are provided between said cover and said pair of clasps.

6. A hair curler as defined in claim 1, wherein each of said pair of connecting portions has two retaining ends in which retaining holes are respectively provided, each of said pair of clasps has two engaging ends on which engaging pieces respectively are outwardly protrusively provided, and said engaging pieces are fitted in said retaining holes of corresponding connecting portions, so that said pair of clasps are rotatably connected to said pair of connecting portions so as to rotate about the longitudinal axes of said clasps.

7. A hair curler as defined in claim 6, wherein hinge portions are provided between said cover and said pair of clasps.

8. A hair curler as defined in claim 1, wherein hinge portions are provided between said cover and said pair of clasps.

9. A hair curler as defined in claim 8, wherein said hinge portions are formed thinner than said cover.

10. A hair curler comprising:

a roller having an outer circumferential surface and opposite axial ends;

a rectangular setting frame including a pair of clasps for clasping hair between each of said pair of clasps and said outer circumferential surface of said roller and first and second connecting portions for connecting said clasps to form a rectangular shape;

said setting frame being releasably engaged with said axial ends of said roller through said first and second connecting portions;

a cover for covering about a half of said outer circumferential surface of said roller between said pair of clasps;

said first connecting portion being divided longitudinally halfway to form a first pair of divided connecting pieces, each of said first pair of divided connecting pieces protruding at one end of each of said clasps, said second connecting portion being divided longitudinally halfway to form a second pair of divided connecting pieces, each of said second pair of divided connecting pieces protruding at the other end of each of said clasps;

said cover, said pair of clasps, said first pair of divided connecting pieces, and said second pair of divided connecting pieces being molded in one body of a synthetic resin;

said cover being made in a mesh form having a multitude of air holes; and first and second connecting pieces for connecting said first pair of divided connecting pieces each other and said second pair of divided connecting pieces each other respectively so that said cover is reversibly bendable with elastic deformation along the outer circumferential surface of said roller.

11. A hair curler as defined in claim 10, wherein said second pair of divided connecting pieces are formed with recesses, said second connecting piece has a pair of engaging portions which engage with said recesses of said second pair of divided connecting pieces, and said second connecting piece has a pair of connecting portions which connect said pair of engaging portions, said second pair of divided connecting pieces being connected with each other by engaging said pair of engaging portions with said recesses of said second pair of divided connecting pieces.

12. A hair curler as defined in claim 11, wherein said first connecting piece has a pair of cylindrical portions which fit on small-diameter portions of said first pair of divided connecting pieces, and hinge portions through which said cylindrical portions can be opened and closed, so that said first pair of divided connecting pieces can be held to be connected with each other by closing said cylindrical portions fitted on said small-diameter portions of said first pair of divided connecting pieces.

13. A hair curler as defined in claim 11, wherein hinge portions are provided between said cover and said pair of clasps.

14. A hair curler as defined in claim 10, wherein said first connecting piece has a pair of cylindrical portions which fit on small-diameter portions of said first pair of divided connecting pieces, and hinge portions through which said cylindrical portions can be opened and closed, so that said first pair of divided connecting pieces can be held to be connected with each other by closing said cylindrical portions fitted on said small-diameter portions of said first pair of divided connecting pieces.

15. A hair curler as defined in claim 10, wherein hinge portions are provided between said cover and said pair of clasps.

* * * * *

UNITED STATES PATENT AND TRADEMARK OFFICE

CERTIFICATE OF CORRECTION

PATENT NO. : 5,829,456

DATED : November 3, 1998

INVENTOR(S) : Toshiyuki FURUKAWA

It is certified that error appears in the above-identified patent and that said Letters Patent is hereby corrected as shown below:

On the title page, item [87] PCT Pub. No. should read:

--[87] PCT Pub. No.: WO95/26658--

Signed and Sealed this

Fourth Day of May, 1999

*Attest:*

Q. TODD DICKINSON

*Attesting Officer*

*Acting Commissioner of Patents and Trademarks*